United States Patent [19]

Smith et al.

[11] Patent Number: 5,008,962

[45] Date of Patent: Apr. 23, 1991

[54] EASY TO FASTEN TROUSERS

[75] Inventors: Lynn U. Smith, 6939 Reynolds St., Pittsburgh, Pa. 15208; Mario J. Merlino, Moscow, Pa.

[73] Assignee: Lynn U. Smith, Pittsburgh, Pa.

[21] Appl. No.: 476,772

[22] Filed: Feb. 8, 1990

[51] Int. Cl.[5] ..... A41D 1/06

[52] U.S. Cl. ..... 2/234; 2/235; 2/227; 2/79; 2/DIG. 7

[58] Field of Search ..... 2/234, 235, 227, 79, 2/DIG. 7

[56] References Cited

U.S. PATENT DOCUMENTS

| | | | |
|---|---|---|---|
| 762,363 | 6/1904 | Talcott | 2/79 |
| 1,888,676 | 11/1932 | Jennings | 2/79 |
| 2,008,152 | 7/1935 | Nier | 2/79 |
| 2,132,117 | 10/1983 | Korolick | 2/228 |
| 2,264,958 | 12/1941 | Smith | 2/227 |
| 2,616,087 | 11/1952 | Werber | 2/79 |
| 3,246,342 | 4/1966 | Pagano | 2/227 |
| 4,447,911 | 5/1984 | Marcellaro | 2/79 |
| 4,457,025 | 7/1984 | Meryash | 2/79 |
| 4,651,353 | 3/1987 | Walden . | |
| 4,914,756 | 4/1990 | Grassick . | |

FOREIGN PATENT DOCUMENTS

| | | | |
|---|---|---|---|
| 2641215 | 3/1978 | Fed. Rep. of Germany | 2/79 |
| 865555 | 5/1941 | France | 2/79 |
| 318165 | 6/1934 | Italy | 2/79 |
| 1340722 | 9/1987 | U.S.S.R. | 2/227 |
| 2027330 | 2/1960 | United Kingdom . | |

*Primary Examiner*—Werner H. Schroeder
*Assistant Examiner*—Gloria Hale
*Attorney, Agent, or Firm*—Webb, Burden, Ziesenheim & Webb

[57] ABSTRACT

Trousers include two selectively openable seams which extend from the upper edge to the hem edge of the trousers, the selectively openable seams being positioned in such a way as to be only minimally visible as the trousers are worn. Each of the two front selectively openable seams converges with its adjacent inseam. A back opening embodiment is also disclosed.

9 Claims, 3 Drawing Sheets

EASY TO FASTEN TROUSERS

FIELD OF THE INVENTION

The invention relates to easily positioned and removed trousers for patients and other users.

BACKGROUND OF THE INVENTION

Of all the garments in standard western dress, trousers are the most difficult to put on. There are many reasons why this is so. For example, the longest bones of the body (femur, etc.) must be directed into and through long tubular sheaths from one end of such sheaths, a task which is awkward by definition. The task is complicated by the fixed position of each trouser leg relative to the other, which requires that both trouser legs be donned (at least partially) at the same time. The task of putting on trousers cannot be accomplished with surety from a standing position, but the task cannot be performed satisfactorily in the sitting position, either.

Putting on trousers may present a trivial inconvenience to the able-bodied, but when trousers are desired to be worn by those having muscular discomfort or weakness, temporary or permanent immobility or disability, balance disorders, arthritis, nervous system damage or adjunct surgical appliances including immobilizers and the like, the difficulty of putting on conventional trousers becomes significant and often insurmountable. As an unfortunate result, patients and others on whom trousers cannot be easily positioned often choose (or their health care providers choose) to do without them. The psychologic disadvantages of having to forego an accustomed garment are profound, and it is well established that individuals who experience discomfort, confusion, disorientation, anxiety or depression or even moderately severe pain can often be made to feel better simply by dressing them—or enabling them to dress themselves—in their customary, psychologically comfortable attire.

A trouser garment which is both good looking and which can easily be positioned and removed would have application not only in traditional patient settings, but could be used to advantage by children with handicaps and by young children learning basic dressing and bathroom routines. Ideally, also, an easily positioned trouser would also accommodate urinary catheters for both men and women.

SUMMARY OF THE PRIOR ART

Certain trouser-like garments form the subject matter of issued patents in the United States and the United Kingdom. U.S. Pat. No. 4,651,353 to Walden, entitled "Disposable Patient Pants," discloses a disposable patient pant having two front panels, two rear panels, a front elastic waistband joining the two front panels on top and a rear elastic waistband joining the two rear panels on top, with the four panels being joined at common seams adjacent the crotch area. United Kingdom Patent No. GB 2,027,330 discloses in FIG. 4 a trouser which opens along the front of each leg. Both of these patents employ long Velcro® (hook pad and loop patch) fastenable seams down the entire front or the entire sides of the trousers. In practice, the trousers disclosed in both of these patents, although functional, provide readily visible long Velcro® strips which detract substantially from the normal appearance of the trousers.

U.S. Pat. No. 2,264,958 to Smith discloses a pants structure in which the crotch can be loosened for comfort during lounging or sleeping. The adjustable nature of the garment of Smith does not, however, contribute to the ease of positioning or fastening such garment.

As is apparent from the above, a need remains for a trouser garment which is both easy to position and to fasten on the wearer and which still presents a substantially normal-appearing garment, to the end that those in need of easily fastenable trousers may enjoy the psychologic benefits of wearing good-looking, normal clothes.

SUMMARY OF THE INVENTION

In order to meet this need, the present trousers are designed so that notwithstanding the inclusion of two selectively openable seams which extend from the upper edge to the hem edge of the trousers, the selectively openable seams are positioned in such a way as to be only minimally visible as the trousers are actually worn. In the present invention, each of the two selectively openable seams converges with its adjacent trouser inseam, so that the substantial length of the selectively openable seam (ordinarily fastened with Velcro®) will fall between the legs of a wearer and will thus show minimally or be invisible.

DETAILED DESCRIPTION OF THE INVENTION

Figure 1:
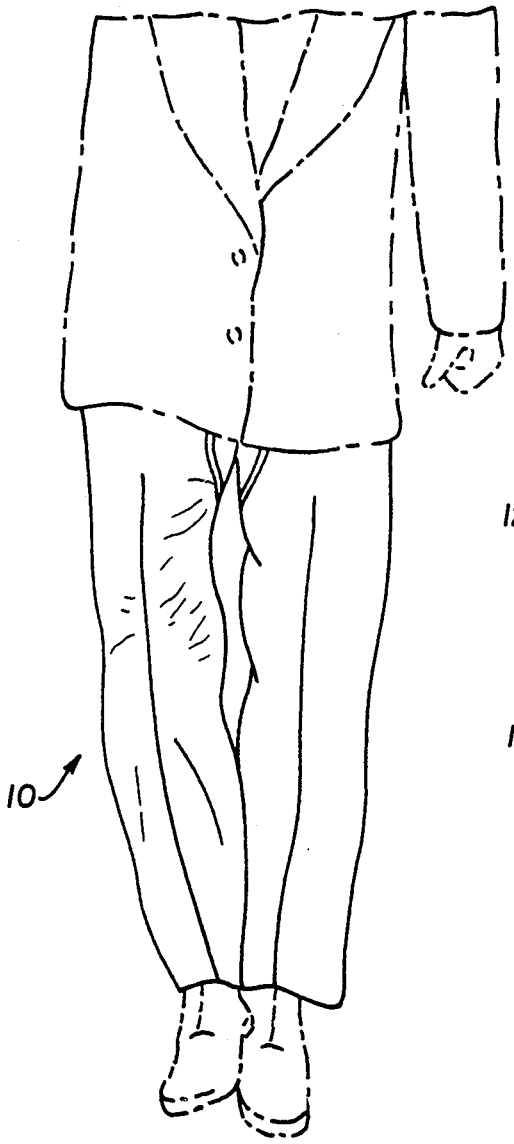
FIG. 1 illustrates the preferred embodiment of the easy to fasten trousers on a mobile wearer walking forward.

FIG. 1 illustrates how, when the present easy to fasten trousers are worn with a long jacket by a mobile wearer, the present trousers appear very much like ordinary trousers. The trousers also appear normal when they are worn by a patient lying in the supine position.

Figure 2:
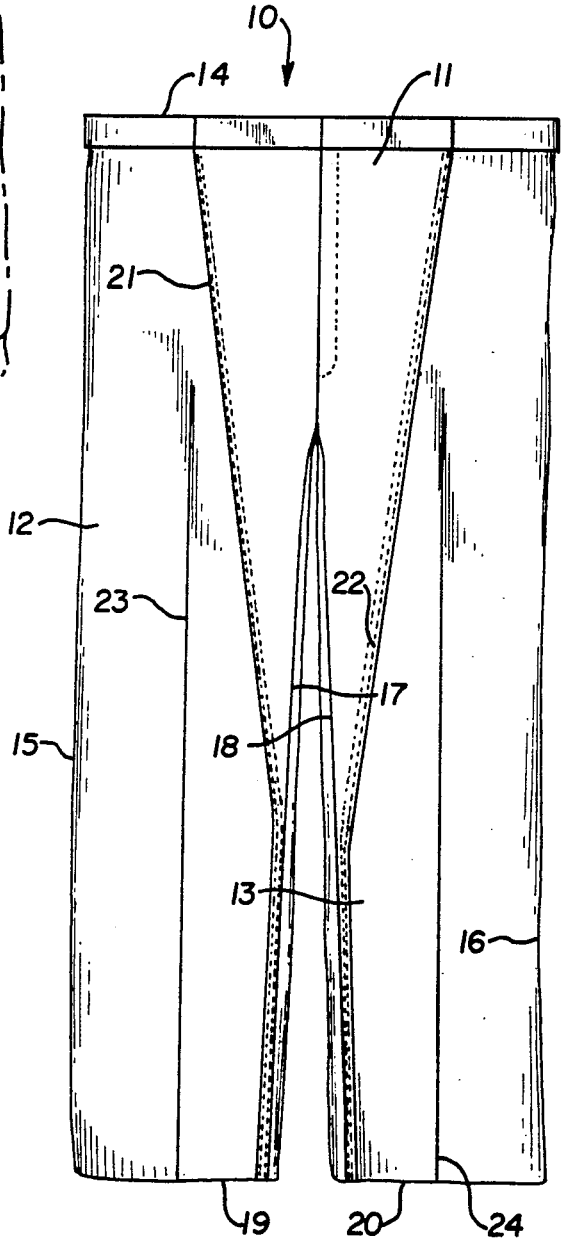
FIG. 2 is a plan view of the front of the embodiment of the invention illustrated in FIG. 1, with the assembled trousers laid horizontally on a flat surface.

Referring now to FIG. 2, the embodiment of the present trousers as shown on a wearer in FIG. 1 is arranged flat, front side up, upon a horizontal surface; the trousers are shown in plan view. The easy to fasten trousers 10 constitute a pelvic sheath 11 integrally formed with a right leg 12 and a left leg 13. The trouser 10 has tailored features ubiquitous to trousers, including the trouser upper edge 14, the right outseam 15, the left outseam 16, the right inseam 17, the left inseam 18, the right hem edge 19, the left hem edge 20, the right crease 23 and the left crease 24. Because all trousers are tailored with a greater expanse of fabric in the back than in the front, the trousers 10 folded flat coincident with their outseams do not likewise fold along the inseams. Accordingly, the right and left inseams 17 and 18 are shown in FIG. 2 as within the top array of the trousers, interior to the folded fabric which defines the inner facing folds of the legs.

An essential feature of the first embodiment of the invention as illustrated in FIG. 2 comprises the right and left front selectively openable seams 21 and 22. The selectively openable seams 21 and 22 as shown in FIG. 2 are fastened by means of mated strips of hook pad and loop patch material (Velcro ®), each half of the mated pair of strips of which is stitched to opposite sides of the selectively openable seam. However, any selectively openable fastening means such as hooks and eyes, snaps, grips and even frogs and laces, etc. may be used for the fastening and releasing of the selectively openable seams 21 and 22 as desired. Velcro ® which is adhesively bonded, not stiched, may also be used.

The selectively openable seams 21 and 22 are selectively openable throughout their lengths, from the tip of the trouser upper edge 14 to the respective right and left hem edges 19 and 20. As is described further below, failure of the selectively openable seams 21 and 22 to extend the entire length of the trousers would defeat the function of the garment as one which is easy to position on the wearer. However, mixed fastener means (that is, combination of Velcro ® strips, hooks and eyes, etc., in different positions) may be used along the selectively openable seams 21 and 22 without defeating the essential nature of these selectively openable (and therefore closable) seams.

Each of the present trousers has two selectively openable seams, one of which runs down each trouser leg. The selectively openable seams 21 and 22 have a unique feature in that they are oriented on the trousers so as to extend from the trouser upper edge 14, at a point horizontally spaced partway between the respective outseam and inseam, along a tapering course diagonally away from the outseam so that the selectively openable seam converges with its adjacent inseam. In other words, the selectively openable seam on each side of the trousers tapers downwardly and inwardly so as to converge with the inseam, rendering a substantial portion of the selectively openable seam removed from view as it passes into the area between the legs. The importance of this design cannot be overemphasized. Even the thinnest mated strips of Velcro ® or other hook pad and loop patch fastener strips are thick enough that an abnormal appearance is readily evident. Tapering of the selectively openable seams 21 and 22 into the area between the legs therefore maximizes normal trouser appearance.

Figure 3:
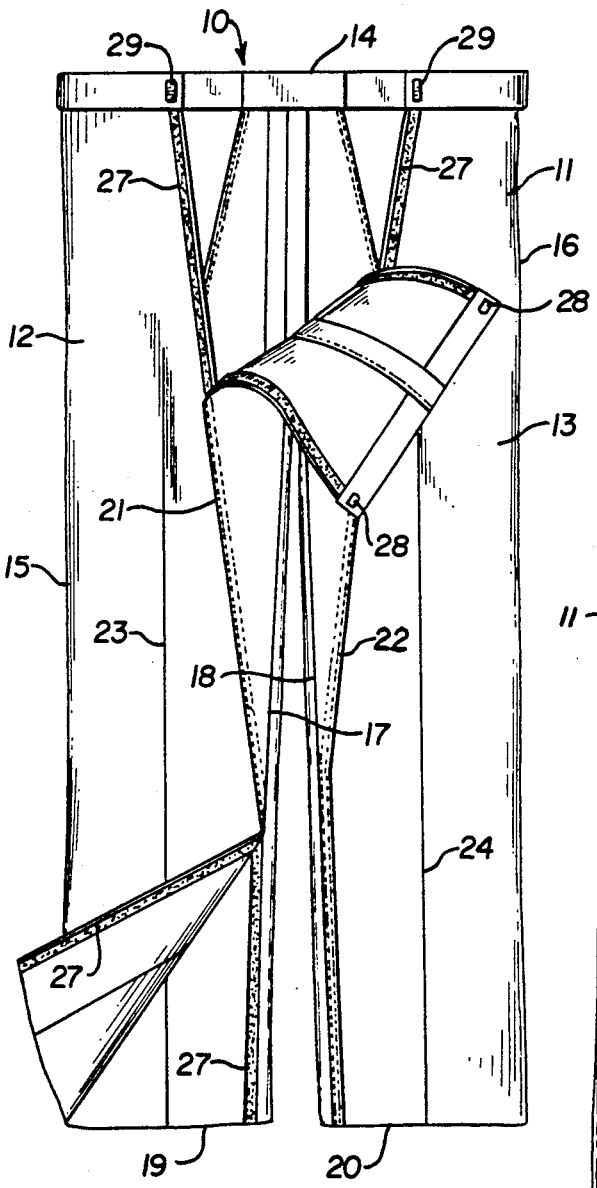
FIG. 3 illustrates the selectively openable seams of FIG. 1 in their partially open position.

Referring now to FIG. 3, which shows the selectively openable seams 21 and 22 of FIG. 2 in partially open position, all of the features of the invention as shown in FIG. 2 may be seen together with a clearer depiction of the fastener strips 27, made of Velcro ® or comparable mating fastener strip material. Hooks 28 and eyes 29 are incorporated in the waistband area near the trouser upper edge 14, for stability and for ease in commencing the mating/fastening operation of adjoining the fastener strips.

Figure 4:
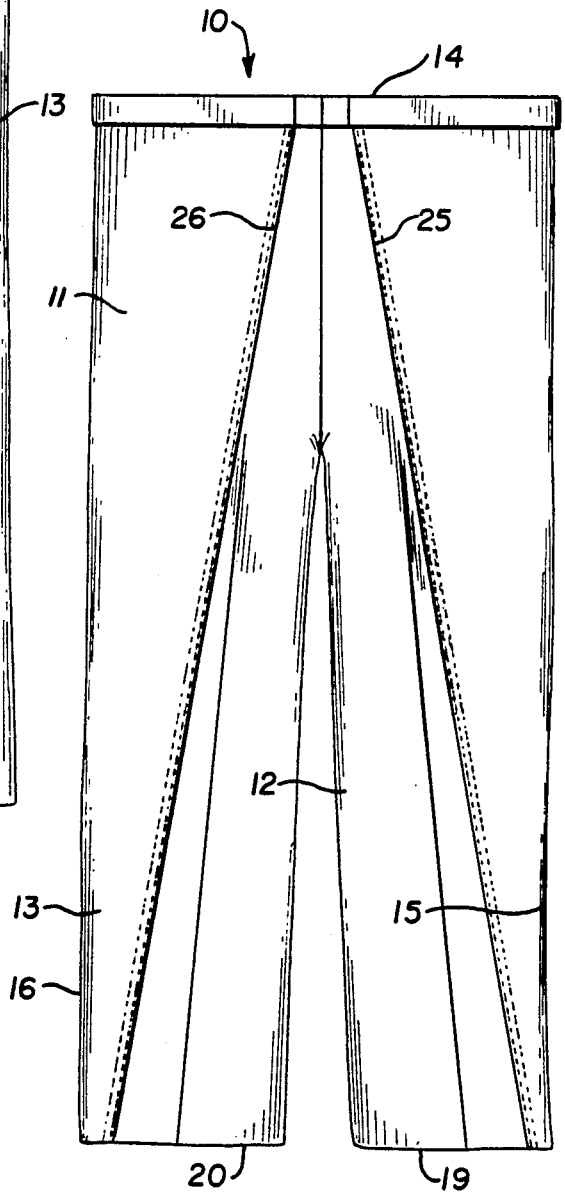
FIG. 4 is the back view of the trousers of FIG. 3.
Figure 5:
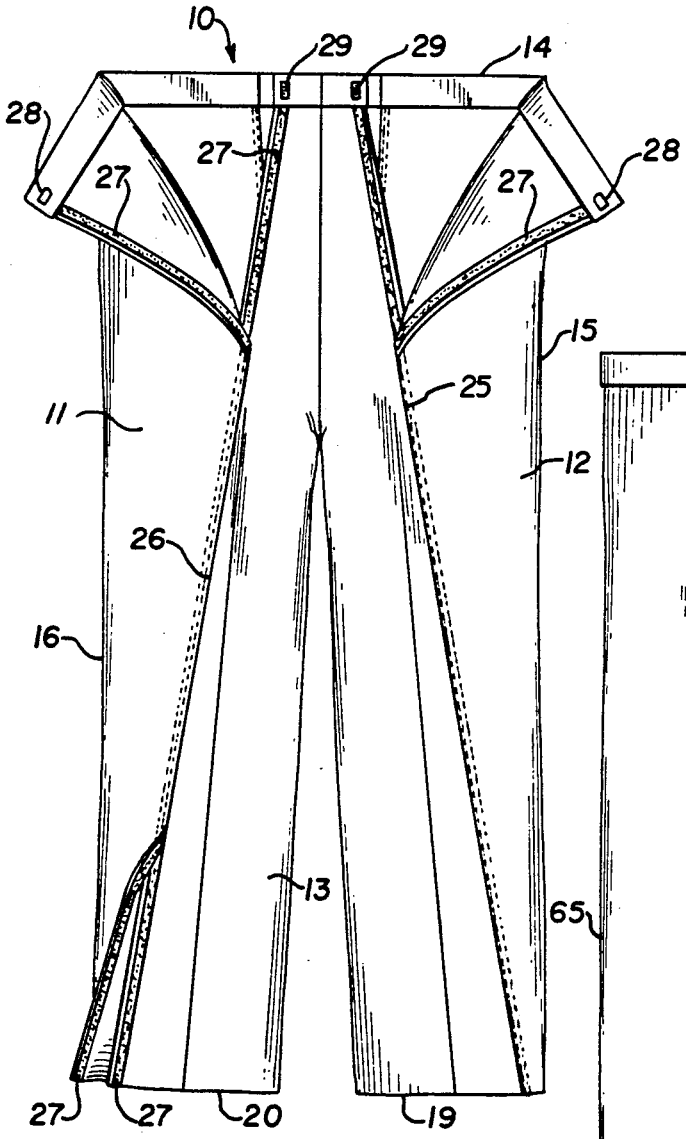
FIG. 5 shows the back selectively openable seams of FIG. 4 in their partial open configuration.

The front of the first embodiment being shown in FIGS. 2 and 3, FIG. 4 illustrates the rear view of the same first embodiment. The back portion of the trousers contains right back and left back selectively openable seams 25 and 26, these seams being similar in all but their diagonal arrangement to the selectively openable seams 21 and 22 on the front of the garment. In the rear of the garment, the selectively openable seams 25 and 26 taper downward from the center back waistband area of the trouser upper edge 14 in a downward and outward direction toward the respective outseams. As shown in FIG. 4, the selectively openable seams 25 and 26 do not converge with the outseams 15 and 16. FIG. 5 shows the selectively openable seams 25 and 26 of FIG. 4 shown in partially opened configuration.

It should be noted that although the first embodiment of the invention illustrated in FIGS. 1–5 contains both front and back selectively openable seams, in the preferred embodiment of the invention the easy to fasten trousers 10 will contain only the two front selectively openable seams 21 and 22 and will contain only conventional tailoring features in the back of the garment. The reason for this is that the back opening feature, provided by the right and left back selectively openable seams 25 and 26, provides seam structures and fasteners in anatomic positions which can annoy, irritate or even ulcerate the dermal and muscular tissue of a patient who wears such a garment in a sitting or reclining position. Notwithstanding the above generality, however, a third alternate embodiment of the invention will contain the right back and left back selectively openable seams only, without the right and left front selectively openable seams. Certain applications make the back opening trousers more feasible, depending upon the needs of the patient.

Figure 6:
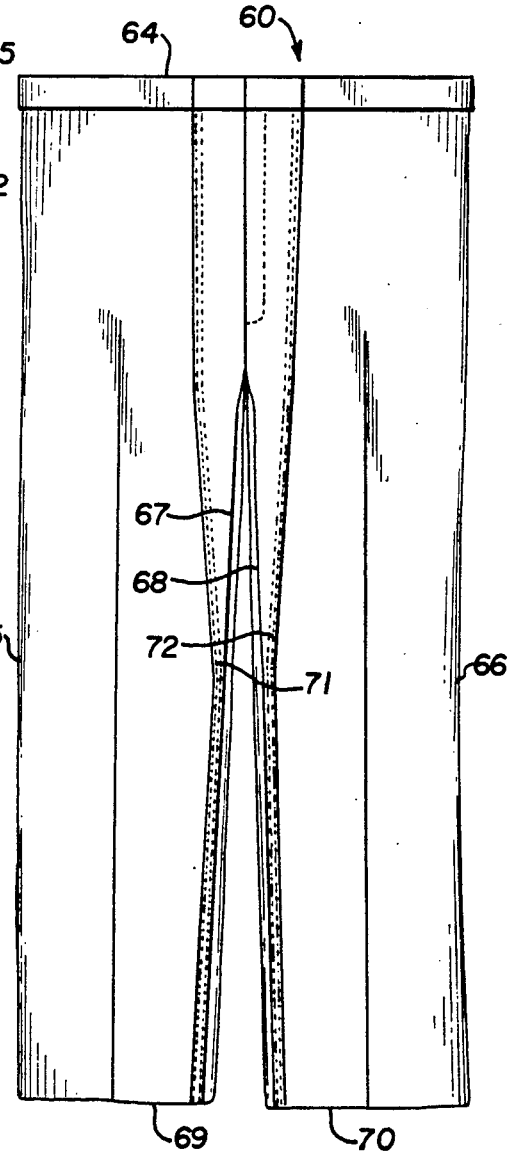
FIG. 6 shows a plan view of the front of a second embodiment of the present trousers, as the trousers are laid out flat on a horizontal surface.

A fourth narrower-panel embodiment of the invention is shown in FIG. 6. FIG. 6 shows an embodiment whereby the right front and left front selectively openable seams provide a narrower and less obtrusive panel central to the trousers 60. The right front and left front selectively openable seams 71 and 72 originate at the trouser upper edge 64 at a point each relatively closer to the respective inseam 67, 68 than to the respective outseam 65, 66. As a result, by means of the downward and inward taper of the right and left selectively openable seams 71 and 72, the seams 71 and 72 converge with their respective right and left inseams 67 and 68 at a point closer to the trouser upper edge 64 (i.e., near or above the knee) than the analogous convergence point as shown in FIG. 2. This configuration provides the advantage of making the selectively openable seams 71 and 72 the least visible of any of the embodiments. Depending upon the preferences of the patient, however, the embodiment shown in FIG. 6 places the selectively openable seams 71 and 72 in a position near the body midline, which may cause discomfort or provide awkward unwanted bulky fabric folds in the abdominal area.

All of the embodiments of the invention function in the same way. Because the trousers are provided with at least two selectively openable seams which extend from the trouser upper edge to the respective hem edge on each side of the trousers, the trousers can be put in place on the patient without the patient having to thread either or both legs through fabric sheaths as is usually required when putting on pants or trousers. By means of opening the two selectively openable seams, the trousers can easily be placed upon the wearer and reassembled, either by the wearer himself or by a health care provider. As a practical matter, placing the easy to fasten trouser of the present invention on a reclining wearer is very much like changing bed sheets around a patient; the patient may be rolled onto his side, the trousers may be placed flat in the area of the patient's original position, the patient may be rolled back onto the trousers and the trousers may be wrapped up and around the pelvis and legs of the wearer and fastened along the selectively openable seams. For the back-opening embodiment of the invention, the trousers may be positioned similarly except the wearer should be rolled from a prone reclining position onto his side, back to a prone position on the spread out trousers, and the trousers can be lifted up and around the legs and posterior pelvic area with subsequent fastening of the selectively openable seams in the back. It is readily evident to those skilled in the art that the trousers may likewise be donned by a wearer in a standing position; the selectively openable seams are opened, the fabric structures are wrapped either front to back or back to front or are otherwise held in position, and the selectively openable seams are secured without the patient ever having to lift even one foot up off the floor. For this reason, the present easy to fasten trousers are particularly well suited to individuals who wish to conserve their strength or who cannot comfortably maintain balance while putting trousers on in the ordinary way.

The embodiment of the invention as shown in FIGS. 2 through 5, which opens both in the back and the front, is suitable, by way of further example, for positioning on a patient immobilized after hip surgery. These patients have absolute immobility by means of femoral braces, but the front and back opening, easy to fasten trousers of the present invention can be threaded in segments into position on the wearer and the four selectively openable seams can then be secured. Of course, the back-opening embodiments of the present trouser should be worn by those in the supine reclining position only for a short time, perhaps for a limited visiting period, because of the possibility of irritation or decubitis ulceration from the presence of the selectively openable seams under the weight-bearing portions of the garment.

No particular fabrics or materials are essential to the present invention, and both conventional natural and synthetic fabrics and paper-related materials and other disposables may be used to manufacture the present trousers. The standard fly front well known in the trouser tailoring arts may either be functional or merely ornamental (fake), and forms no part of the present invention. Most pocket styles can be incorporated into the present trousers, although of course patch pocket styles which would ordinarily be placed over the location of the selectively openable seams cannot be used. Various types of the hook pad and loop patch fasteners may be used, including the woven and nonwoven backed Velcro® products having different weights and thicknesses. Ideally, a hook pad and loop patch strip fastener is selected which is soft enough to minimize the appearance of a Velcro® seam, but which provides enough body for easy handling by either the wearer or a health care provider. However, any type of Velcro® or other fasteners including zippers may be used. Other tailoring aspects of the trousers are known in the art, including serging of fabric edges, use of curtain, fusible, fly lining, etc. Women's trousers can be fashioned with a Hollywood waist or other features typical of women's fashion styles. Naturally, any number of other design or style changes can be accommodated by the present design, which design requires primarily the existence and positioning of the selectively openable seams as described. Accordingly, trousers may be fashioned for the able-bodied and for children as readily as for the handicapped.

Although the invention has been described with particularity above, the invention is to be limited only insofar as is set forth in the accompanying claims.

I claim:

1. In trousers having an upper edge, a pelvic sheath, and two adjacent legs each having an outseam, an inseam and a hem edge, the improvement comprising two selectively openable seams, each of said selectively openable seams extending down the front portion of its own respective trouser leg from said upper edge to one of said hem edges, with each of said selectively openable seams being positioned at said upper edge at a horizontal position between the respective adjacent outseam and respective adjacent inseam of said trouser leg and tapering diagonally away from said outseam and into the area of said respective adjacent inseam.

2. The trousers according to claim 1 wherein each of said selectively openable seams is positioned at said upper edge at a horizontal position nearer said respective adjacent inseam than said respective adjacent outseam.

3. The trousers according to claim 1 wherein each of said selectively openable seam is secured at least in part with hook pad and loop patch fastener strips.

4. The trousers according to claim 3 wherein each of said selectively openable seams is secured at least in part with both hooks and eyes and hook pad and loop patch fastener strips.

5. The trousers according to claim 1 wherein third and fourth selectively openable seams are provided to the back panels of the two trouser legs, respectively.

6. The trousers according to claim 5 wherein said third and fourth selectively openable seams taper from a position at the horizontal center region of the upper edge downwardly and outwardly toward an outseam.

7. The trousers according to claim 1 wherein each of said selectively openable seams converges with said respective adjacent inseam at a position in the knee area of the trousers.

8. The trousers according to claim 3 wherein each of said selectively openable seams converges with said adjacent inseam at a position above the knee area of the trousers.

9. In trousers having an upper edge, a pelvic sheath, and two adjacent legs each having an outseam, an inseam and a hem edge, the improvement comprising two selectively openable seams, each of said selectively openable seams extending down the back portion of its own respective trouser leg from said upper edge to one of said hem edges, with each of said selectively openable seams tapering downwardly toward said respective adjacent outseam.

* * * * *